US011441785B2

(12) United States Patent
Park et al.

(10) Patent No.: US 11,441,785 B2
(45) Date of Patent: Sep. 13, 2022

(54) GAS FURNACE

(71) Applicant: LG ELECTRONICS INC., Seoul (KR)

(72) Inventors: Janghee Park, Seoul (KR); Jusu Kim, Seoul (KR); Hansaem Park, Seoul (KR); Yongki Jeong, Seoul (KR); Doyong Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/885,687

(22) Filed: May 28, 2020

(65) Prior Publication Data

US 2020/0378622 A1 Dec. 3, 2020

(30) Foreign Application Priority Data

May 31, 2019 (KR) ..... 10-2019-0064291
May 27, 2020 (KR) ..... 10-2020-0063578

(51) Int. Cl.
*F23D 14/62* (2006.01)
*F23L 11/00* (2006.01)
(Continued)

(52) U.S. Cl.
CPC ..... *F24D 5/02* (2013.01); *F23C 9/08* (2013.01); *F23D 14/04* (2013.01); *F23D 14/62* (2013.01);
(Continued)

(58) Field of Classification Search
CPC ..... B01F 5/0413; B01F 2005/0048; B01F 5/0401; F02M 26/19; F02M 21/047;
(Continued)

(56) References Cited

U.S. PATENT DOCUMENTS 4,991,561 A * 2/1991 Gerassimov ..... F02B 43/00 123/527
5,477,846 A * 12/1995 Cameron ..... F24H 3/087 126/109
(Continued)

FOREIGN PATENT DOCUMENTS

EP 2 949 994 12/2015
FR 2 972 789 9/2012
(Continued)

OTHER PUBLICATIONS

European Search Report dated Oct. 2, 2020 issued in Application No. 20177300.9.
(Continued)

*Primary Examiner* — Jorge A Pereiro
(74) *Attorney, Agent, or Firm* — KED & Associates

(57) ABSTRACT

Disclosed is a gas furnace including a mixer configured to mix air and fuel gas introduced from an intake pipe and a manifold respectively so as to produce an air-fuel mixture, a mixing pipe configured to allow the air-fuel mixture having passed through the mixer to flow therein, a burner assembly configured to combust the air-fuel mixture having passed through the mixing pipe so as to generate combustion gas, heat exchangers configured to allow the combustion gas to flow therein, an exhaust pipe configured to discharge exhaust gas, which is the combustion gas having passed through the heat exchangers, to the outside. The gas furnace further includes a recirculator installed around the exhaust pipe and configured to guide a portion of the exhaust gas flowing in the exhaust pipe to the mixer, and may thus greatly reduce or fundamentally block $NO_x$ emissions.

20 Claims, 8 Drawing Sheets

(51) Int. Cl.

| | |
|---|---|
| ***F24D 5/02*** | (2006.01) |
| ***F23C 9/08*** | (2006.01) |
| ***F23D 14/04*** | (2006.01) |
| ***F23D 14/64*** | (2006.01) |
| ***F23D 14/70*** | (2006.01) |

(52) U.S. Cl.
CPC ..... *F23D 14/64* (2013.01); *F23D 14/70* (2013.01); *F23L 11/00* (2013.01); *F23D 2203/007* (2013.01); *F23N 2235/10* (2020.01)

(58) Field of Classification Search
CPC ..... F24H 3/065; F23C 2202/10; F24D 5/02; F23D 14/62; F23D 2203/007
See application file for complete search history.

(56) References Cited

U.S. PATENT DOCUMENTS 5,492,404 A * 2/1996 Smith ..... B01F 5/0057 366/165.1
5,527,367 A 6/1996 Harada
5,560,350 A * 10/1996 Kim ..... F24H 8/00 126/113
5,690,070 A * 11/1997 Wendel ..... F02M 3/07 123/339.25
6,062,205 A * 5/2000 Bevan ..... F02M 26/21 123/568.24
6,767,007 B2 * 7/2004 Luman ..... B01F 3/0446 261/76
8,490,606 B2 * 7/2013 Zeitoun ..... F02M 26/19 123/568.11
8,668,489 B2 * 3/2014 Chiappetta ..... F24H 3/105 431/12
9,863,371 B2 * 1/2018 El Gammal ..... F02M 35/10222
10,533,740 B2 * 1/2020 Shaw ..... F23D 14/02
2004/0025805 A1 2/2004 Kayahara et al.
2004/0173192 A1 * 9/2004 Sorter ..... F02M 21/0239 123/528
2004/0262556 A1 * 12/2004 Everingham ..... F16K 31/047 251/129.11
2005/0001185 A1 * 1/2005 Everingham ..... F02M 26/54 251/69
2006/0245296 A1 * 11/2006 Nishioka ..... F23D 14/64 366/174.1
2008/0187794 A1 * 8/2008 Weingaertner .... H01M 8/04201 429/414
2010/0288955 A1 * 11/2010 Bonanno ..... F16K 11/0853 251/209
2011/0101813 A1 * 5/2011 Tbatou ..... H02K 1/34 310/156.35
2012/0148963 A1 * 6/2012 Carey ..... F23C 3/002 431/9
2012/0178031 A1 * 7/2012 Roy ..... F23D 14/62 431/12
2012/0247444 A1 10/2012 Sherrow et al.
2013/0037013 A1 * 2/2013 Roy ..... F23D 23/00 126/116 R
2013/0213378 A1 * 8/2013 Schultz ..... F23C 9/00 126/110 C
2013/0213379 A1 * 8/2013 Schultz ..... F24H 3/08 126/110 C
2013/0302737 A1 * 11/2013 Schultz ..... F24H 9/02 431/6
2014/0202443 A1 * 7/2014 Sherrow ..... F23D 14/62 126/116 R
2014/0331669 A1 * 11/2014 Jones ..... F02M 26/19 60/605.2
2015/0192291 A1 * 7/2015 Akbarimonfared ..... F23D 14/14 126/116 R
2016/0178236 A1 * 6/2016 Garloch ..... F24H 3/00 126/116 A
2016/0230706 A1 * 8/2016 Schwark ..... F02M 35/10222
2018/0043319 A1 * 2/2018 Schneider ..... B01F 15/00935

FOREIGN PATENT DOCUMENTS

JP 11324812 A * 11/1999 ..... F02M 26/07
WO WO 2012/006166 1/2012

OTHER PUBLICATIONS

European Search Report issued in Application No. 21197062.9 dated Jan. 19, 2022.

* cited by examiner

GAS FURNACE

CROSS-REFERENCE TO RELATED APPLICATION

This application claims the priority benefit of Korean Patent Application No. 10-2019-0064291, filed on May 31, 2019, and Korean Patent Application No. 10-2020-0063578, filed on May 27, 2020, in the Korean Intellectual Property Office, the entire disclosures of all of which are hereby expressly incorporated by reference into the present application.

BACKGROUND OF THE INVENTION

1. Field of the Invention

The present disclosure relates to a gas furnace, and more particularly to a gas furnace which may greatly reduce or fundamentally block NOx emissions by mixing re-circulated exhaust gas with air and fuel gas before combustion.

2. Description of the Related Art

In general, a gas furnace is an apparatus which heats an indoor space by supplying air, having exchanged heat with flame and high-temperature combustion gas generated due to combustion of fuel gas, to the indoor space, and FIG. 1 illustrates a conventional gas furnace.

Referring to FIG. 1, in a burner assembly 4, flame and high-temperature combustion gas may be generated when fuel gas and air are combusted. Here, the fuel gas is introduced into the burner assembly 4 via a manifold 3 from a gas valve (not shown). The high-temperature combustion gas may pass through heat exchangers 5 and be discharged to the outside through an exhaust pipe 8. Here, indoor air introduced into a gas furnace 1 through an indoor air duct D1 by a blower 6 may be heated through the heat exchangers 5 and be guided to the indoor space through an air supply duct D2, and consequently heat the indoor space.

The flow of the combustion gas passing through the heat exchangers 5 and the exhaust pipe 8 is driven by an inducer 7, and condensate water generated when the combustion gas passes through the heat exchangers 5 and/or the exhaust pipe 8 and is condensed may be discharged to the outside through a condensate water trap 9.

Thermal NOx (hereinafter abbreviated to NOx), produced through a chemical reaction between nitrogen and oxygen in the air at a high temperature (specifically, in a state in which a flame temperature is about 1,800 K or higher) during the combustion process of the fuel gas in the gas furnace 1, is a representative contaminant causing air pollution, and the quantity of emitted NOx is being regulated by air quality regulatory agencies.

For example, in the US, the quantity of emitted NOx is regulated by the South Coast Air Quality Management District (SCAQMD), and the SCAQMD has tightened regulations, specifically, has lowered the allowable quantity of emitted NOx from 40 ng/J (nano-grams per Joule) to 14 ng/J.

Accordingly, development of technologies for reducing NOx emissions from gas furnaces is actively underway, and U.S. Patent Laid-open Publication No. 20120247444A1 discloses a premixing gas furnace, in which air and fuel gas are mixed in advance before combustion, and discloses a technological configuration, in which generation of NOx is reduced by lowering a flame temperature by increasing an air ratio.

However, there is a limit to the extent to which the flame temperature can be lowered merely by adjusting the air ratio in the above U.S. Patent Document, and an excessive increase in the air ratio may cause flame instability.

Further, in the case of the above U.S. Patent Document, operation of an inducer for increasing the air ratio may cause energy loss.

Meanwhile, no structure or measure for increasing the mixing ratio of air to fuel gas in order to prevent the generation of NOx due a local increase in the flame temperature during a combustion process, caused by a relatively low mixing ratio of the air to the fuel gas, has been suggested.

SUMMARY OF THE INVENTION

Therefore, the present disclosure has been made in view of the above problems, and it is an object of the present disclosure to provide a gas furnace which may greatly reduce or fundamentally block NOx emissions.

It is another object of the present disclosure to provide a gas furnace which may reduce the amount of energy consumed in order to reduce NOx emissions.

It is a further object of the present disclosure to provide a gas furnace which has a structure to increase a mixing ratio of air to fuel gas and exhaust gas.

In accordance with the present disclosure, the above and other objects can be accomplished by the provision of a gas furnace including a mixer configured to mix air and fuel gas respectively introduced from an intake pipe and a manifold so as to produce an air-fuel mixture, a mixing pipe configured to allow the air-fuel mixture having passed through the mixer to flow therein, a burner assembly configured to combust the air-fuel mixture having passed through the mixing pipe so as to generate combustion gas, heat exchangers configured to allow the combustion gas to flow therein, and an exhaust pipe configured to discharge exhaust gas, which is the combustion gas having passed through the heat exchangers, to the outside.

The gas furnace may further include a recirculator installed around the exhaust pipe and configured to guide a portion of the exhaust gas flowing in the exhaust pipe to the mixer, and thus greatly reducing or fundamentally blocking NOx emissions.

The recirculator may include a damper housing installed around the exhaust pipe, a damper disposed within the damper housing so as to be rotatable, a rotary motor connected to one side of the damper so as to rotate the damper, and a recirculation pipe provided with one side connected with the damper housing and a remaining side connected to the mixer, and the damper may form a flow path configured to communicate with a flow path formed in a part of the exhaust pipe located at a front end of the damper housing and a flow path formed in a part of the exhaust pipe located at a rear end of the damper housing.

The damper, in a first state, may form a first flow path such that all of the exhaust gas introduced from the part of the exhaust pipe located at the front end of the damper housing into the damper is guided to the part of the exhaust pipe located at the rear end of the damper housing.

The damper, in a second state, may form a second flow path such that a portion of the exhaust gas introduced from the part of the exhaust pipe located at the front end of the damper housing into the damper is guided to the part of the exhaust pipe located at the rear end of the damper housing and a remainder of the exhaust gas is guided to the recirculation pipe. The second state may be a state in which the damper is rotated from a position of the damper the first state at a designated angle in a designated direction by the rotary motor.

The gas furnace may have the following configuration of the mixer so as to increase the mixing ratio of the air to the fuel gas and/or the exhaust gas.

The mixer may include a mixer housing configured such that the intake pipe is connected to a front end thereof, the mixing pipe is connected to a rear end thereof, and the manifold and the recirculation pipe are connected to a side surface thereof so as to be spaced apart from each other, and a venturi tube located within the mixer housing.

The venturi tube may include a converging section provided with an inlet formed at one end thereof such that the air having passed through the intake pipe is introduced into the inlet, a first throat connected to the converging section and provided with fuel inlet holes formed through at least a portion of a side surface thereof such that the fuel gas having passed through the manifold is introduced into the fuel inlet holes, a first diverging section connected to the first throat and configured such that the air and the fuel gas having passed through the converging section and the fuel inlet holes respectively are mixed therein to produce the air-fuel mixture, a second throat connected to the first diverging section and provided with exhaust gas inlet holes formed through at least a portion of a side surface thereof such that the exhaust gas having passed through the recirculation pipe is introduced into the exhaust gas inlet holes, and a second diverging section connected to the second throat and configured such that the air-fuel mixture and the exhaust gas having passed through the first diverging section and the exhaust gas inlet holes respectively are mixed therein to produce a final mixture, and provided with an outlet formed at one end thereof such that the final mixture is discharged to the mixing pipe from the outlet.

The converging section may be configured such that a diameter thereof is gradually decreased in a downstream direction, and thus increase an intake rate of the air into the venturi tube, and each of the first and second diverging sections may be configured such that a diameter thereof is gradually increased in the downstream direction, and thus increase a mixing ratio of the air to the fuel gas and/or the exhaust gas.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF EXEMPLARY EMBODIMENTS

Figure 1:
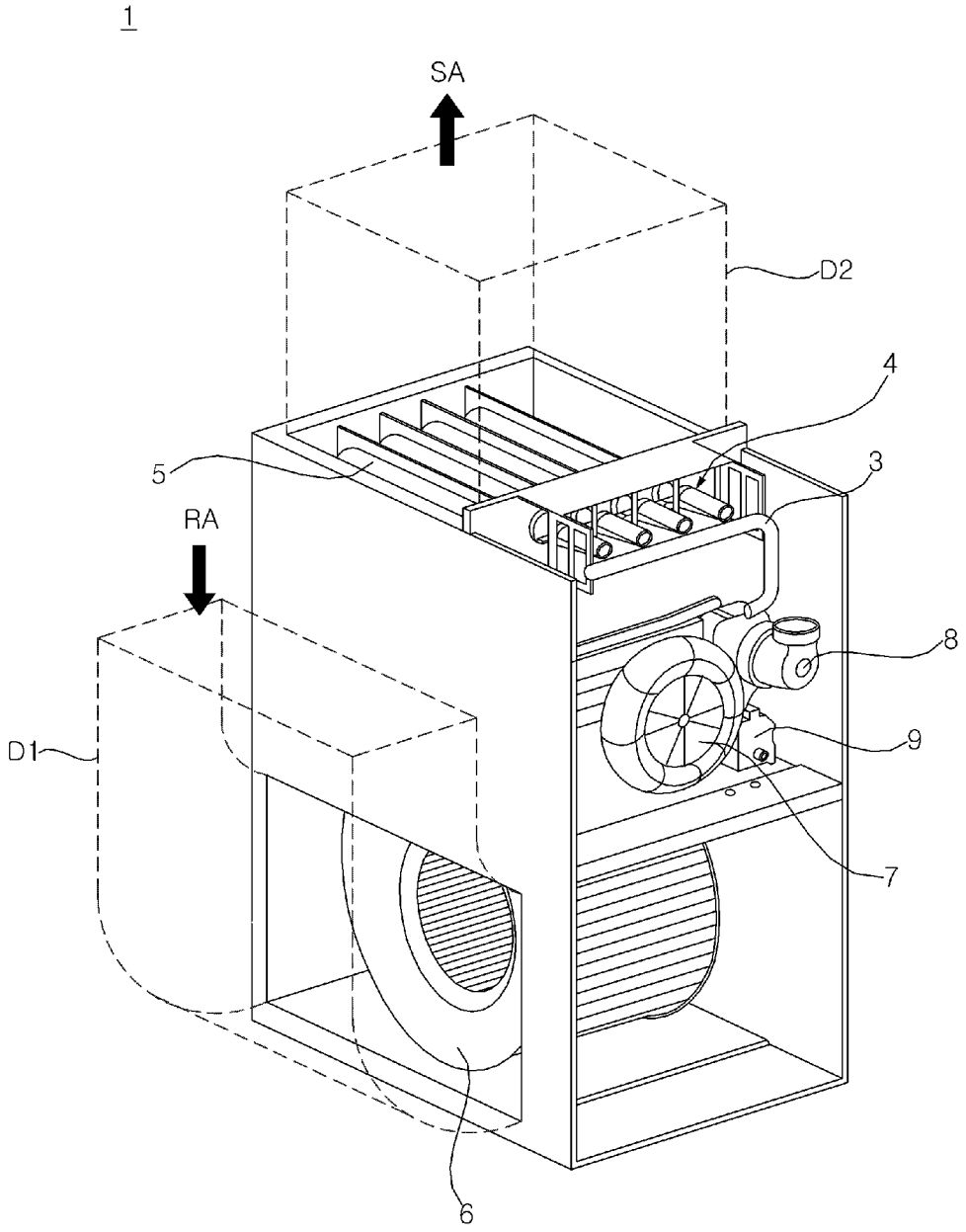
FIG. 1 is a perspective view of a conventional gas furnace.

The advantages and features of the present disclosure and the way of attaining the same will become apparent with reference to embodiments described below in conjunction with the accompanying drawings. However, the present disclosure is not limited to the embodiments disclosed herein but may be implemented in various different forms. The embodiments are provided to make the description of the present disclosure thorough and to fully convey the scope of the present disclosure to those skilled in the art. It is to be noted that the scope of the present disclosure is defined merely by the claims. In the following description of the embodiments and the drawings, the same or similar elements are denoted by the same reference numerals throughout the specification.

In the following description of the embodiments of the present disclosure with reference to the accompanying drawings including FIG. 2, a three-dimensional Cartesian coordinate system including the X-axis, the Y-axis and the Z-axis, which intersect each other at right angles, will be described. In the following description of the embodiments of the present disclosure, a vertical direction is defined as a Z-axis direction, a forward or backward direction is defined as an X-axis direction, and a lateral direction is defined as a Y-axis direction. Each axis direction (the X-axis direction, the Y-axis direction or the Z-axis direction) may encompass both directions in which each axis extends. A '+' sign added to each axis direction (i.e., the +X-axis direction, the +Y-axis direction or the +Z-axis direction) means a positive direction, i.e., one of both directions in which each axis extends. A '−' sign added to each axis direction (i.e., the −X-axis direction, the −Y-axis direction or the −Z-axis direction) means a negative direction, i.e., another of both directions in which each axis extends.

Hereinafter, a gas furnace according to one embodiment of the present disclosure will be described in detail with reference to FIGS. 2 to 8.

Figure 2:
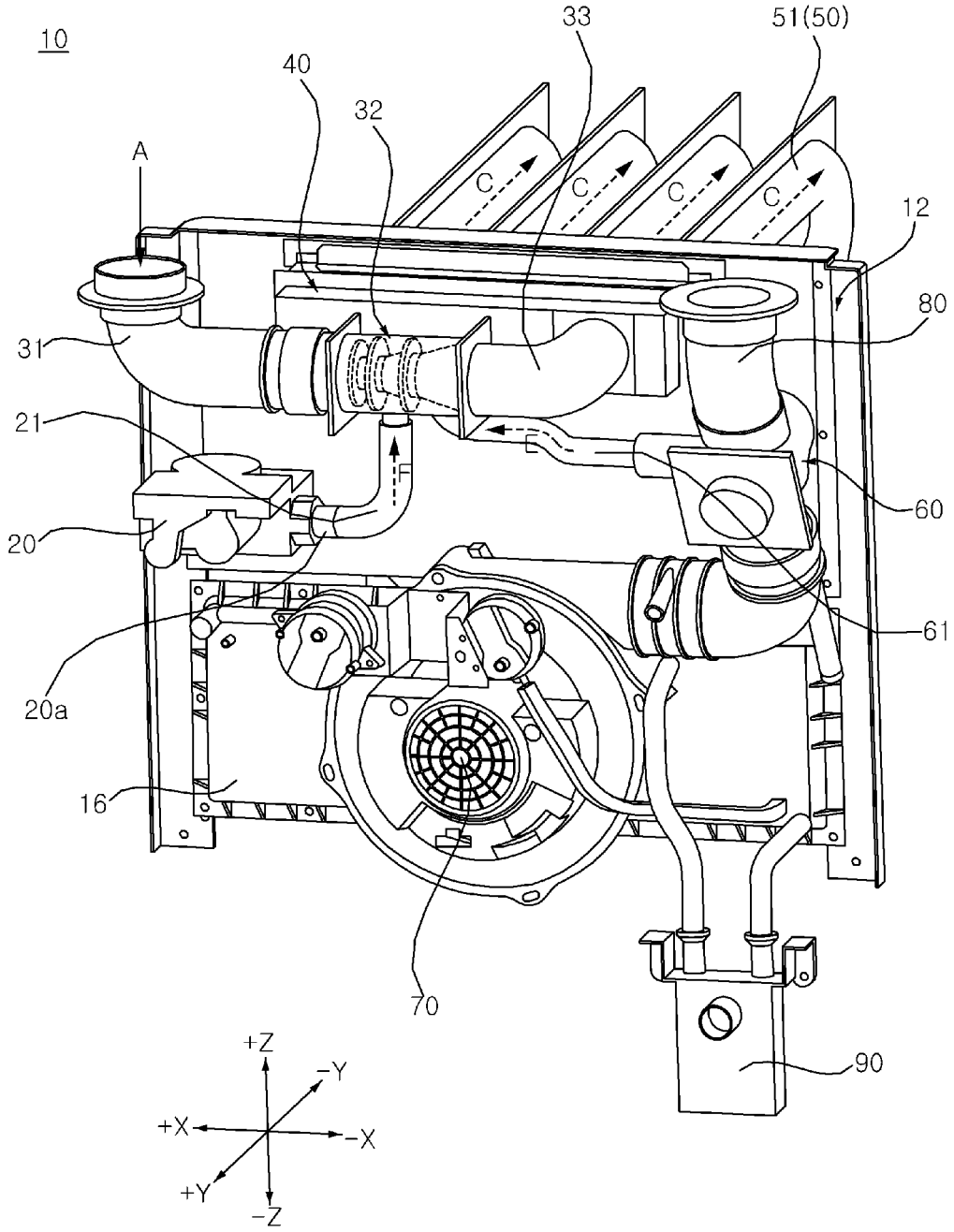
FIG. 2 is a perspective view illustrating some elements of a gas furnace according to one embodiment of the present disclosure.

FIG. 2 is a perspective view illustrating some elements of the gas furnace according to one embodiment of the present disclosure.

A gas furnace 10 according to one embodiment of the present disclosure is an apparatus which heats an indoor space by supplying air, having exchanged heat with flame and high-temperature combustion gas C generated due to combustion of fuel gas F, to the indoor space.

Referring to FIG. 2, the gas furnace 10 includes a mixer 32 in which the air A and the fuel gas F and/or exhaust gas E are mixed, a mixing pipe 33 in which a mixture having passed through the mixer 32 flows, a burner assembly 40 which combusts the mixture having passed through the mixing pipe 33 to produce the combustion gas C, and heat exchangers 50 through which the combustion gas C flows.

Further, the gas furnace 10 includes an inducer 70 which causes a flow of the combustion gas C to an exhaust pipe 80 via the heat exchangers 50, a blower (not shown) which blows air supplied to an indoor space around the heat exchangers 50, and a condensate water trap 90 which collects condensate water generated from the heat exchangers 50 and/or the exhaust pipe 80 and then discharges the condensate water to the outside.

The air A may be introduced into the mixer 32 via an intake pipe 31, and the fuel gas F may be introduced into the mixer 32 via a manifold 21 from a gas valve 20 and a nozzle 20*a*. Here, the fuel gas F may be, for example, Liquefied Natural Gas (LNG) which is produced by cooling natural gas, or Liquefied Petroleum Gas (LPG) which is produced by pressurizing gas which is a by-product obtained when refining petroleum.

The fuel gas F may be supplied to the manifold 21 or the supply of the fuel gas F to the manifold 21 may be blocked by opening or closing the gas valve 20, and the quantity of the fuel gas F supplied to the manifold 21 may be adjusted by controlling the opening degree of the gas valve 20. Consequently, the gas valve 20 may be used to adjust the heating power of the gas furnace 10.

The mixing pipe 33 may be configured such that a mixture of the air A and the fuel gas F and/or the exhaust gas E may flow therein, as will be described below. The mixing pipe 33 may guide the mixture to the burner assembly 40, which will be described below, and mixing of the gases may continue while the mixture is guided to the burner assembly 40 by the mixing pipe 33.

The mixture introduced into the burner assembly 40 may be combusted due to ignition using an igniter. In this case, the mixture may be combusted, and thus, flame and high-temperature combustion gas C may be generated.

Flow paths along which the combustion gas C flows may be formed in the heat exchangers 50. Although this embodiment illustrates the heat exchangers 50 as including first heat exchangers 51 and second heat exchangers (not shown), which will be described below, only the first heat exchangers 51 may be provided according to embodiments.

The first heat exchangers 51 may be configured such that one end of each of the first heat exchangers 51 is disposed adjacent to the burner assembly 40. The other end of each of the first heat exchangers 51 may be coupled to a hot collect box (HCB, not shown). The combustion gas C flowing from one end to the other end of each of the first heat exchangers 51 may be transmitted to the second heat exchangers (not shown) through the HCB.

One end of each of the second heat exchangers may be connected to the HCB. The combustion gas C having passed through the first heat exchangers 51 may be introduced into one end of each of the second heat exchangers, and pass through the second heat exchangers. The second heat exchangers 52 may perform again heat exchange between the combustion gas C having passed through the first heat exchangers 51 and air passing around the second heat exchangers 52. Thermal energy of the combustion gas C, having passed through the first heat exchangers 51, is additionally used through the second heat exchangers, and thereby, efficiency of the gas furnace 10 may be improved.

The combustion gas C passing through the second heat exchangers is condensed during a process of transferring heat to the air passing around the second heat exchangers, thereby being capable of producing condensate water. That is to say, vapor included in the combustion gas C is changed into a liquid state, i.e., is condensed into the condensate water. Because of this, the gas furnace 10 including the first heat exchangers 51 and the second heat exchangers may be referred to as a condensing gas furnace. Here, the generated condensate water may be collected in a cold collect box (CCB) 16. For this purpose, the other end of each of the second heat exchangers may be connected to one side surface of the CCB 16.

The condensate water generated by the second heat exchangers may be supplied to the condensate water trap 90 through the CCB 16, and be discharged to the outside of the gas furnace 10 via a condensate outlet. In this case, the condensate water trap 90 may be coupled to the other side surface of the CCB 16. Further, the condensate water trap 90 may collect and discharge condensate water generated by the exhaust pipe 80 connected to the inducer 70 in addition to the condensate water generated by the second heat exchangers. That is, condensate water, generated when the uncondensed combustion gas C from the other end of the second heat exchangers 52 is condensed by passing through the exhaust pipe 80, may also be collected in the condensate water trap 90 in addition to the condensate water generated by the second heat exchangers 52, and then be discharged to the outside of the gas furnace 10 via the condensate outlet.

The inducer 70 which will be described below may be coupled to the other side surface of the CCB 16. Although the inducer 70 is described as being coupled to the CCB 16 for the purpose of brevity of description, the inducer 70 may be coupled to a mounting plate 12 to which the CCB 16 is coupled.

The CCB 16 may be provided with an opening. The other end of each of the second heat exchangers 52 and the inducer 70 may communicate with each other via the opening formed through the CCB 16. That is, the combustion gas C having passed through the other end of each of the second heat exchangers 52 may be supplied to the inducer 70 through the opening formed through the CCB 16, and be discharged to the outside of the gas furnace 10 via the exhaust pipe 80.

The inducer 70 may communicate with the other end of each of the second heat exchangers 52 via the opening formed through the CCB 16. One end of the inducer 70 may be coupled to the other side surface of the CCB 16, and the other end of the inducer 70 may be coupled to the exhaust pipe 80. The inducer 70 may cause a flow of the combustion gas C to the exhaust pipe 80 via the first heat exchangers 51, the HCB and the second heat exchangers. In this regard, the inducer 70 may be referred to as an Induced Draft Motor (IDM).

The blower (not shown) may be located under the gas furnace 10, in the same manner as the blower 6 of the conventional gas furnace 1 shown in FIG. 1. Air supplied to the indoor space may flow from the lower portion to the upper portion of the gas furnace 10 by the blower. In this regard, the air blower may be referred to as an Indoor Blower Motor (IBM).

The blower may cause air to pass around the heat exchangers 50. The air passing around the heat exchangers 50 by the blower may receive thermal energy from the high-temperature combustion gas C through the heat exchangers 50, and thus, the temperature of the air passing around the heat exchangers 50 may be raised. The air having the raised temperature is supplied to the indoor space, thereby being capable of heating the indoor space.

The gas furnace 10 may include a case (not shown), in the same manner as the conventional gas furnace 1 shown in FIG. 1. The above-described elements of the gas furnace 10 may be received within the case.

A lower opening (not shown) is formed through the lower portion of a side surface of the case adjacent to the blower. An indoor air duct D1, through which air introduced from the indoor space (hereinafter referred to as indoor air RA) passes, may be installed at the lower opening. An air supply duct D2, through which the air supplied to the indoor space (hereinafter referred to as supplied air SA) passes, may be installed at an upper opening (not shown) formed through the upper portion of the case.

That is, when the blower is operated, the temperature of the indoor air RA introduced from the indoor space through the indoor air duct D1 may be raised while the indoor air RA passes through the heat exchangers 50, and the indoor air RA having the raised temperature may be supplied as the supplied air SA to the indoor space through the air supply duct D2, thereby heating the indoor space.

The above-described gas furnace 10 according to one embodiment of the present disclosure is different from the conventional gas furnace 1 shown in FIG. 1 in the following ways.

That is, in the conventional gas furnace 1, fuel gas having passed through the manifold 3 may be injected into the burner assembly 4 through nozzles installed at the manifold 3, pass through a venturi tube (not shown) of the burner assembly 4, and be mixed with air naturally inhaled into the burner assembly 4 to produce a mixture. However, the conventional gas furnace 1 having the above configuration has difficulty in reducing the quantity of emitted NOx for the following reasons.

First, it will be understood that the conventional gas furnace 1 forms a partial premixing mechanism in which the fuel gas injected from the nozzles and primary air introduced through a space between the lower portion of the burner assembly 4 and the nozzles pass through the venturi tube and are mixed to produce the mixture, and then the mixture and secondary air introduced through a space between the upper portion of the burner assembly 4 and the heat exchangers 5 are combusted together so as to exhibit the characteristics of diffusion combustion.

However, in the conventional gas furnace 1 forming the partial premixing mechanism, due to the characteristics of diffusion combustion in which the diffusion rate of flame is much lower than the combustion reaction rate, it may be difficult to lower a flame temperature even if control is performed to supply the excess quantity of the secondary air. Further, it is difficult to control an air ratio (i.e., a ratio of an actual quantity of air to a theoretical quantity thereof) and thus there is a limit to the extent to which the quantity of emitted NOx can be reduced.

In order to solve the above problems, the present disclosure provides the gas furnace 10 which may form a complete premixing mechanism and greatly reduce or fundamentally block NOx emissions by re-circulating a portion of exhaust gas, and the gas furnace 10 will be described below in more detail.

Figure 3:
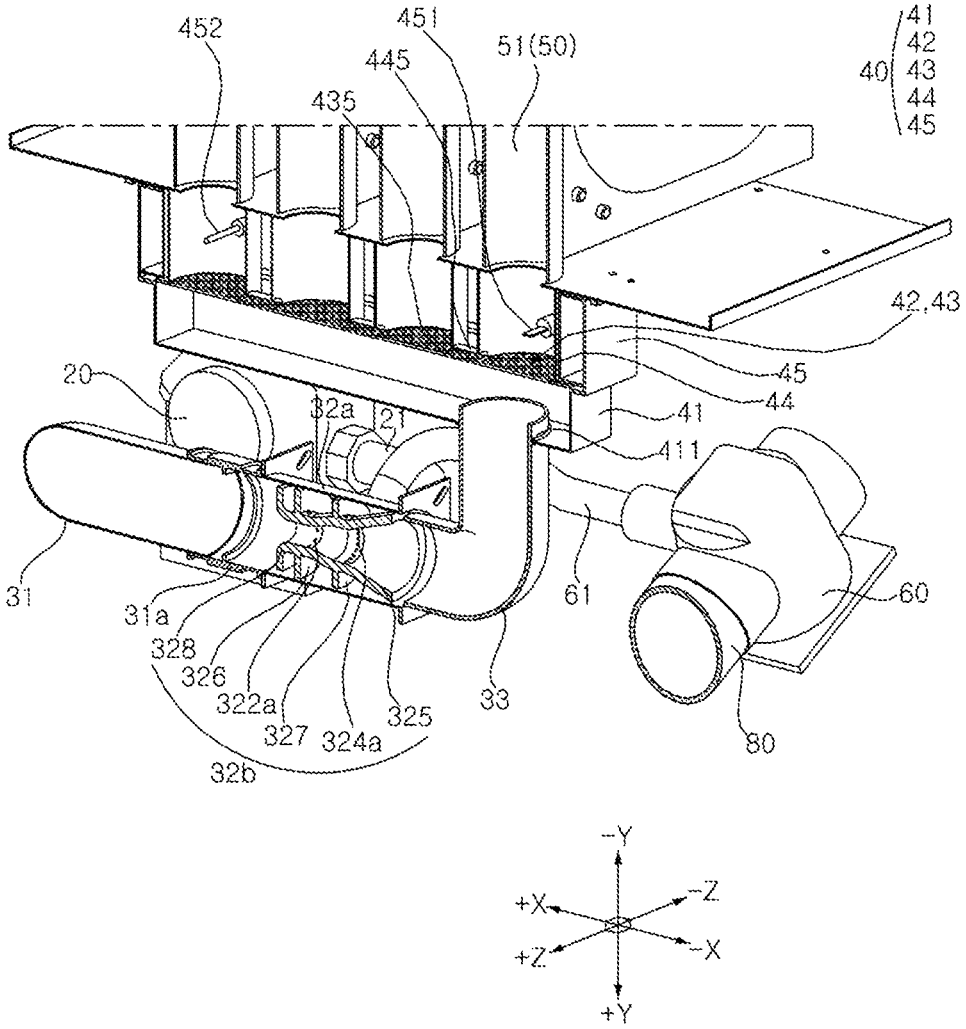
FIG. 3 is a partially cutaway cross-sectional view of the gas furnace according to one embodiment of the present disclosure.

FIG. 3 is a partially cutaway cross-sectional view of the gas furnace according to one embodiment of the present disclosure.

Referring to FIGS. 2 and 3, the gas furnace 10 includes the mixer 32, the mixing pipe 33, the burner assembly 40, the heat exchangers 50, the exhaust pipe 80, and a recirculator 60.

The mixer 32 mixes air A and fuel gas F respectively introduced from the intake pipe 31 and the manifold 21, thus producing an air-fuel mixture. Here, the intake pipe 31 is a pipe, one side of which is exposed to the outside such that the air A participating in the combustion reaction is drawn thereinto, the manifold 21 is a pipe, one side of which is connected to the gas valve 20 such that the fuel gas F participating in the combustion reaction flows therein, and the quantity of the fuel gas F flowing in the manifold 21 may be adjusted according to whether or not the gas valve 20 is opened or closed or the opening degree of the gas valve 20, as described above.

The mixture produced by the mixer 32 may be supplied to the burner assembly 40 via the mixing pipe 33, and in this case, the air A and the fuel gas F participating in the combustion reaction are in a completely premixed state and then supplied to the burner assembly 40, and thus it may be easy to lower the flame temperature by adjusting the air ratio (i.e., adjusting the quantity of inhaled air so as to supply the excess quantity of air to the combustion reaction). Further, since the intake pipe 31, the mixer 32, the mixing pipe 33, the burner assembly 40 and the heat exchangers 50 communicate with each other, NOx emissions may be greatly reduced by lowering the flame temperature by easily adjusting the air ratio through operation of the inducer 70. That is to say, in order to reduce NOx emissions, combustion conditions in a fuel lean region may be easily achieved.

In the present disclosure, in order to increase a mixing ratio of the air A to the fuel gas F and/or the exhaust gas E in the mixer 32, the venturi effect, which will be described below in detail, is used.

The mixture having passed through the mixer 32 may flow into the mixing pipe 33. The mixture having passed through the mixing pipe 33 may be combusted in the burner assembly 40, thus being capable of generating flame and high-temperature combustion gas C.

The burner assembly 40 may include a mixing chamber 41, burners 42, a burner plate 43, combustion chambers 44 and a burner box 45. The gas furnace 10 may include a plurality of first heat exchangers 51. In this case, the gas furnace 10 may include the burners 42 and the combustion chamber 44 provided in a number corresponding to the number of the first heat exchangers 51. For example, in the gas furnace 10, four first heat exchangers 51 may be arranged parallel to each other, and correspondingly, four burners 42 and four combustion chambers 44 may be provided.

The mixing chamber 41 may mediate transfer of the mixture from the mixing pipe 33 to the burners 42. That is, the mixing pipe 33 may be connected to a connector 411 formed at one side of the mixing chamber 41, and the mixture having passed through the mixing pipe 33 may be introduced into the mixing chamber 41 through the connector 411 and then be supplied to the burners 42. While the mixture is guided to the burners 42 through the mixing chamber 41, mixing of gases may continue.

Flame generated when the mixture is combusted may be placed on the burners 42. For example, the burner 42 may include a perforated burner plate 42*a* and a burner mat 42*b*.

A plurality of ports through which the mixture is injected may be formed through the perforated burner plate 42*a*. For example, the perforated burner plate 42*a* may be formed of stainless steel. The perforated burner plate 42*a* may perform a function of uniformly distributing the mixture to the burner mat 42*b* which will be described below, and in this case, redistribution of the flow of the mixture may be carried out between the perforated burner plate 42*a* and the burner mat 42*b* and thus assist the mixture to flow more uniformly. Further, in the case in which the burner 42 includes the perforated burner plate 42*a* in addition to the burner mat 42*b*, flame stability may be improved compared to the case in which the burner 42 includes only the burner mat 42*b* in some embodiments. In addition, the perforated burner plate 42*a* may perform a function of supporting the burner mat 42*b*.

The burner mat 42*b* may be coupled to the upper surface of the perforated burner plate 42*a*, and thus more uniformly distribute the mixture injected through the ports of the perforated burner plate 42*a*. Thereby, the flame may be more stably placed on the burner mat 42*b*. For example, the burner mat 42*b* may be formed of metal fibers having a smaller gap therebetween than the diameter of the ports. The burner mat 42*b* having the above configuration may be understood as an assembly of circular cylinders configured such that the injection rate of the mixture is close to '0', and thereby, flame may be stably placed on the surface of the burner mat 42*b*. Consequently, flame stability may be excellent, which advantageously enables adjustment of the heating power of the gas furnace 10 over a broad range. That is, the burner mat 42*b* having the above configuration may advantageously prevent flashback of flame when the heating power of the gas furnace 10 is considerably lowered, and may prevent blowout of the flame when the heating power of the gas furnace 10 is considerably raised.

The burners 42 provided in plural may be coupled to one side of the burner plate 43. A plurality of burner holes communicating with the combustion chambers 44 provided in plural may be formed through the body of the burner plate 43.

One end of the combustion chamber 44 may be coupled to the other side of the burner plate 43, and the other end of the combustion chamber 44 may be located adjacent to the first heat exchangers 51. The mixing chamber 41 may be coupled to one end of the burner box 45, and one side of the mounting plate 12 may be coupled to the other end of the burner box 45. Further, the burners 42, the burner plate 43 and the combustion chambers 44 may be located within the burner box 45.

The gas furnace 10 may further include an igniter 451 located within the combustion chamber 44. For example, the igniter 451 may be installed on the inner surface of the burner box 45, and be inserted into a hole formed in the combustion chamber 44. When the mixture introduced into the burners 42 via the connector 411 is combusted due to ignition using the igniter 451, flame and high-temperature combustion gas C may be generated and the generated flame may be placed on the burners 42.

Even when the igniter 451 is located in only any one of the combustion chambers 44, flame may propagate between adjacent burners 42 through flame propagation holes 435 formed through the burner plate 43. In this case, the burner assembly 40 may include flame propagation tunnels 445 which are formed at positions corresponding to the positions of the flame propagation holes 435 between adjacent combustion chambers 44 so as to form a flame propagation path with the flame propagation holes 435.

The flame propagation tunnels 445 may prevent the mixture injected from the flame propagation holes 435 from leaking to the outside, and thus allow the flame propagation holes 435 to function to propagate flame between the respective burners 42.

The mixture having passed through the mixing pipe 33 may be distributed to the flame propagation holes 435 as well as the burners 42 via the mixing chamber 41, and flame may propagate between adjacent burners 42 through the flame propagation path between the flame propagation holes 435 and the flame propagation tunnels 445.

That is, based on a mechanism in which flame placed on one of the burners 42 adjacent to the flame propagation hole 435 combusts the mixture injected from the flame propagation hole 435 and thus generates flame, and the generated flame combusts the mixture injected from the other of the burners 42 adjacent to the flame propagation hole 435 and thus generates flame, the flame may propagate between the respective burners 42 through the flame propagation holes 435.

The high-temperature combustion gas C having passed through the combustion chambers 44 may be supplied to the insides of the first heat exchangers 51. That is, since the high-temperature combustion gas C generated by the respective burners 42 is guided to the respective heat exchangers 51 via the respective combustion chambers 44, the gas furnace 10 may reduce thermal loss compared to the case in which an integrated burner corresponding to a plurality of heat exchangers is provided (i.e., the case in which a portion of flame and high-temperature combustion gas C generated by the integrated burner leaks between the heat exchangers and thus causes thermal loss).

The gas furnace 10 may further include a flame sensor 452 located within the combustion chamber 44. For example, the flame sensor 42 may be installed on the inner surface of the burner box 45, and be inserted into a hole formed in the combustion chamber 44. Even when the flame sensor 452 is located in only any one of the combustion chambers 44, the flame sensor 452 may sense whether or not flame is generated in response to operation of the gas furnace 10 due to the characteristics of the gas furnace 10 of the present disclosure, in which the flame sequentially propagates between the burners 42 through the flame propagation holes 435. If the flame sensor 452 senses that no flame is generated in response to the operation of the gas furnace 10, there is a safety risk, and thus, supply of the fuel gas F to the manifold 21 must be cut off by closing the gas valve 20.

A gas flow path, in which the high-temperature combustion gas C generated due to the above-described combustion reaction flows, may be formed in the heat exchangers 50. The combustion gas having passed through the heat exchangers 50 (hereinafter referred to as exhaust gas E) may be discharged to the outside through the exhaust pipe 80 via the inducer 70, as described above. Here, condensate water generated by condensing the exhaust gas E in the heat exchangers 50, particularly in the second heat exchangers and the exhaust pipe 80, may be collected in the condensate water trap 90 and then be discharged to the outside, as described above.

Figure 4:
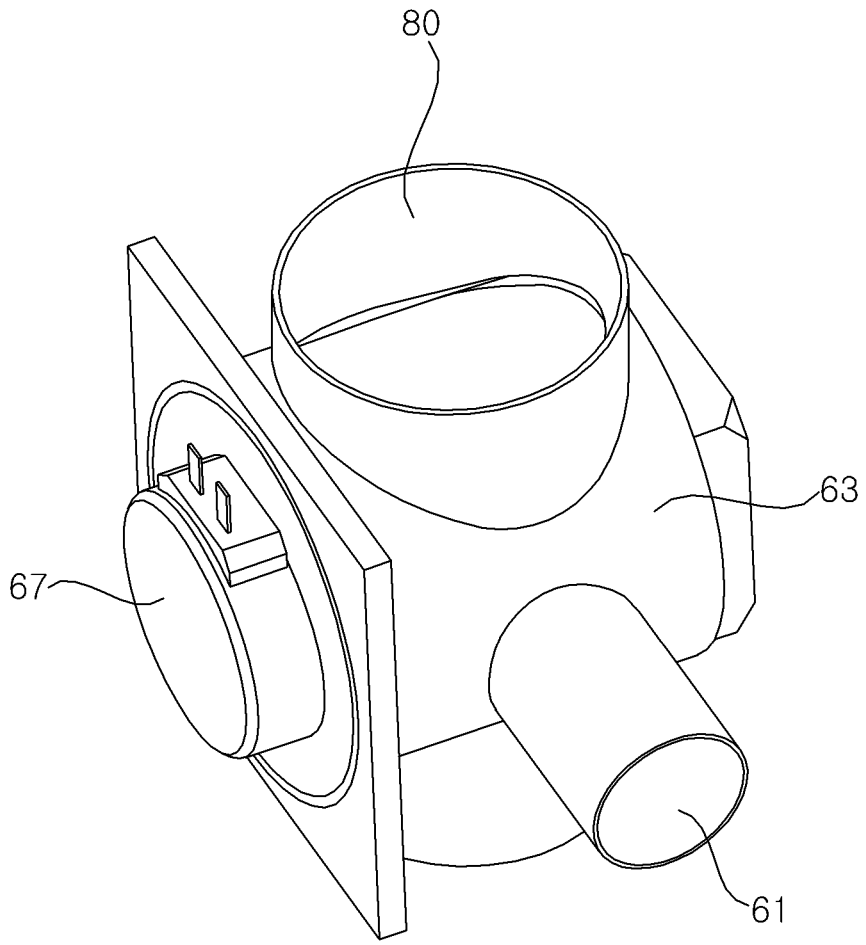
FIG. 4 is a perspective view of a recirculator of the gas furnace according to one embodiment of the present disclosure.
Figure 5:
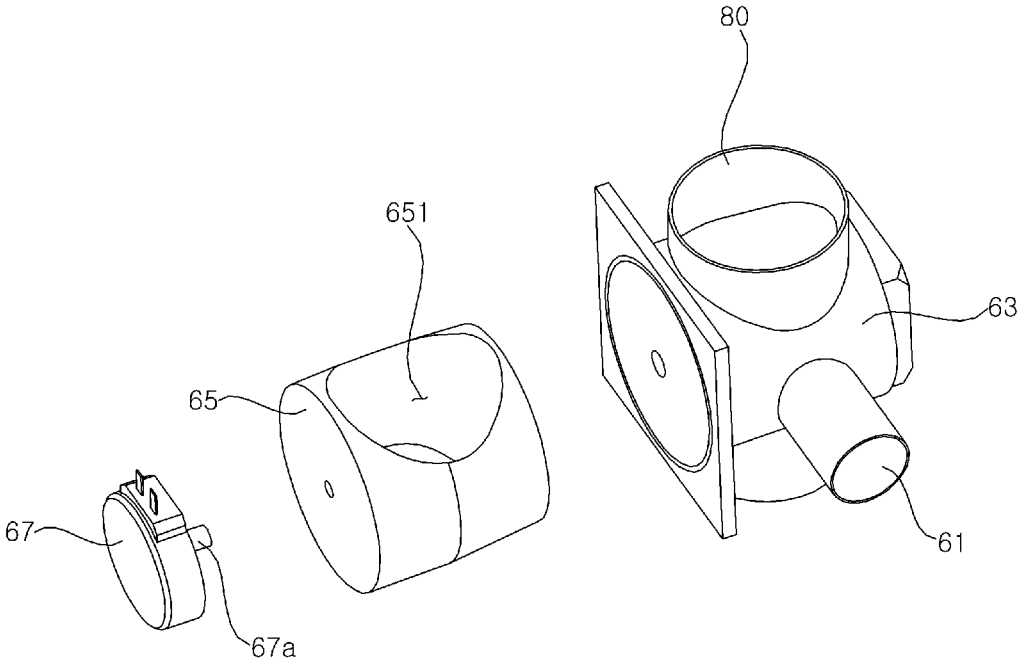
FIG. 5 is an exploded perspective view of the recirculator of the gas furnace according to one embodiment of the present disclosure.

FIG. 4 is a perspective view of the recirculator of the gas furnace according to one embodiment of the present disclosure, and FIG. 5 is an exploded perspective view of the recirculator of the gas furnace according to one embodiment of the present disclosure.

The recirculator 60 may be installed around the center of the exhaust pipe 80 and guide a portion of the exhaust gas E flowing in the exhaust pipe 80 to the mixer 32 (with reference to FIGS. 2 and 3).

Referring to FIGS. 4 and 5, the recirculator 60 may include a damper housing 63, a damper 65, a rotary motor 67, and a recirculation pipe 61.

The damper housing 63 may be installed around the exhaust pipe 80, and form the external appearance of the recirculator 60. The exhaust pipe 80 may be connected to each of the front and rear ends of the damper housing 63. Here, a part of the exhaust pipe 80 located at the front end of the damper housing 63 is located upstream relative to a part of the exhaust pipe 80 located at the rear end of the damper housing 63.

The damper 65 may be disposed within the damper housing 63 so as to be rotatable. The damper 65 may form a flow path 651 communicating with a flow path formed in the part of the exhaust pipe 80 located at the front end of the damper housing 63 and a flow path formed in the part of the exhaust pipe 80 located at the rear end of the damper housing 63.

The rotary motor 67 may include a rotation shaft 67*a* connected to one side of the damper 65, and rotate the damper 65. For example, the rotary motor 67 may be a servomotor which may adjust the rotational angle thereof in stages in response to a designated control signal. Thereby, the quantity of the exhaust gas E supplied to the mixer 32 through the recirculation pipe 61, which will be described below, may be controlled by adjusting the rotational angle of the damper 65.

In this regard, the gas furnace 10 may further include a controller (not shown) configured to control the quantity of the exhaust gas E flowing in the recirculation pipe 61 by adjusting whether or not the rotary motor 67 is to be rotated or the rotational angle of the rotary motor 67. The controller may control the quantity of the exhaust gas E flowing in the recirculation pipe 61 based on information, such as the quantity of the fuel gas F, the RPM of the inducer 70, the flame temperature, etc.

The controller may be implemented using at least one of application specific integrated circuits (ASICs), digital signal processors (DSPs), digital signal processing devices (DSPDs), programmable logic devices (PLDs), field programmable gate arrays (FPGAs), processors, controllers, microcontrollers, microprocessors, or electrical units for performing other functions.

One side of the recirculation pipe 61 may be connected to the damper housing 63, and the other side of the recirculation pipe 61 may be connected to the mixer 32. As described above and will be described below, the exhaust gas E may be supplied to the mixer 32 through the recirculation pipe 61.

Change in the flow path 651 and a flow route of the exhaust gas E according to the rotating operation of the damper 65 will be described below.

The damper 65, in a first state, may form a first flow path such that all of the exhaust gas E introduced from the part of the exhaust pipe 80 located at the front end of the damper housing 63 into the damper 65 is guided to the part of the exhaust pipe 80 located at the rear end of the damper housing 63. Here, the first state may be understood as the state of the damper 65 shown in in FIG. 5. In this case, it is difficult to expect supply of the exhaust gas E to the mixer 32 through the recirculation pipe 61. Further, a state in which the damper 65 is rotated from the position of the damper 65 in the first state at a designated angle in a designated direction by the rotary motor 67 may be referred to as a second state.

The damper 65, in the second state, may form a second flow path such that a portion of the exhaust gas E introduced from the part of the exhaust pipe 80 located at the front end of the damper housing 63 into the damper 65 is guided to the part of the exhaust pipe 80 located at the rear end of the damper housing 63 and a remainder of the exhaust gas E is guided to the recirculation pipe 61. Here, the second state may be understood as a state in which the damper 65 shown in FIG. 5 is rotated at a designated angle in the clockwise direction as seen from the rotary motor 67. In this case, supply of the exhaust gas E to the mixer 32 through the recirculation pipe 61 may be expected.

By supplying a portion of the exhaust gas E flowing in the exhaust pipe 80 to the mixer 32 in which air and fuel gas F are mixed, the flame temperature is lowered by gas having high specific heat, such as carbon dioxide, among the exhaust gas E, and thereby, generation of NOx may be greatly reduced or fundamentally prevented. Further, the gas furnace 10 including the recirculator 60 having the above configuration may be referred to as a Flue Gas Recirculation (FGR) gas furnace.

Further, the gas furnace 10 according to one embodiment of the present disclosure uses recirculation of the exhaust gas E in addition to adjustment of the air ratio so as to reduce NOx emissions, and may thus reduce power consumption of the inducer 70 or noise caused by the operation of the inducer 70, compared to technology for reducing NOx emissions merely by adjusting the air ratio.

Figure 6:
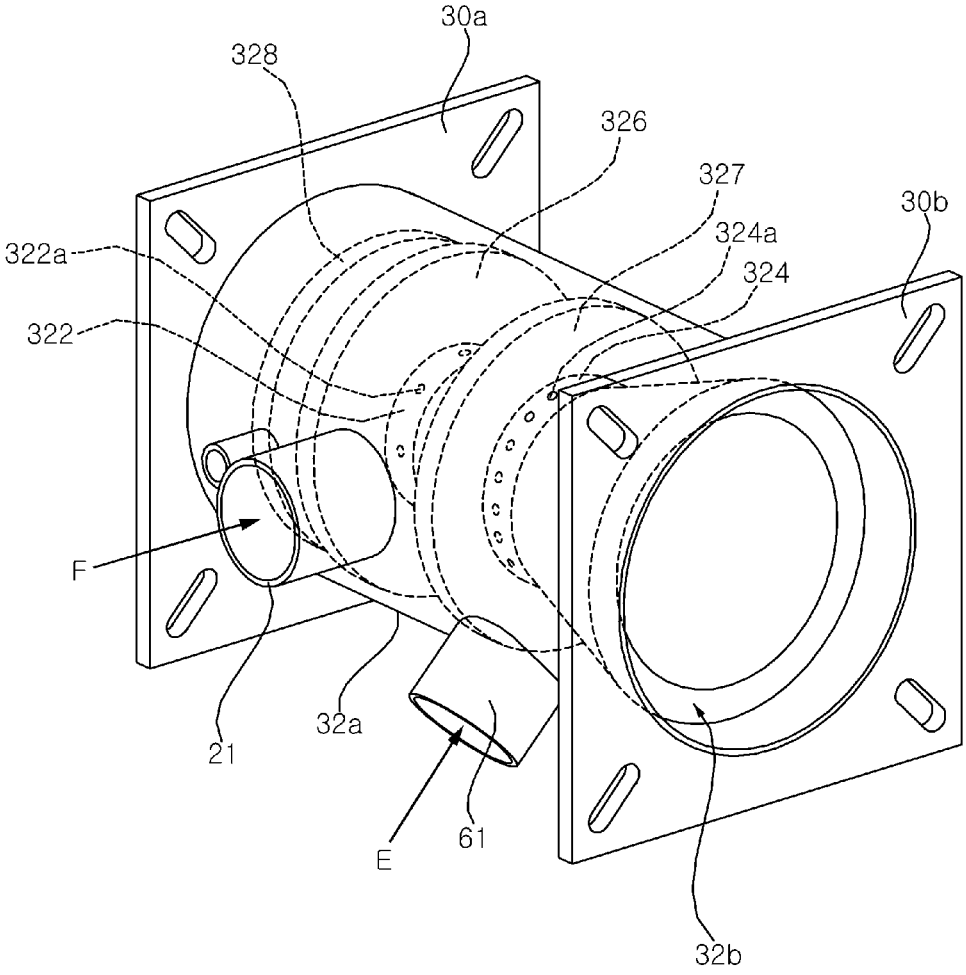
FIG. 6 is a perspective view of a mixer of the gas furnace according to one embodiment of the present disclosure.
Figure 7:
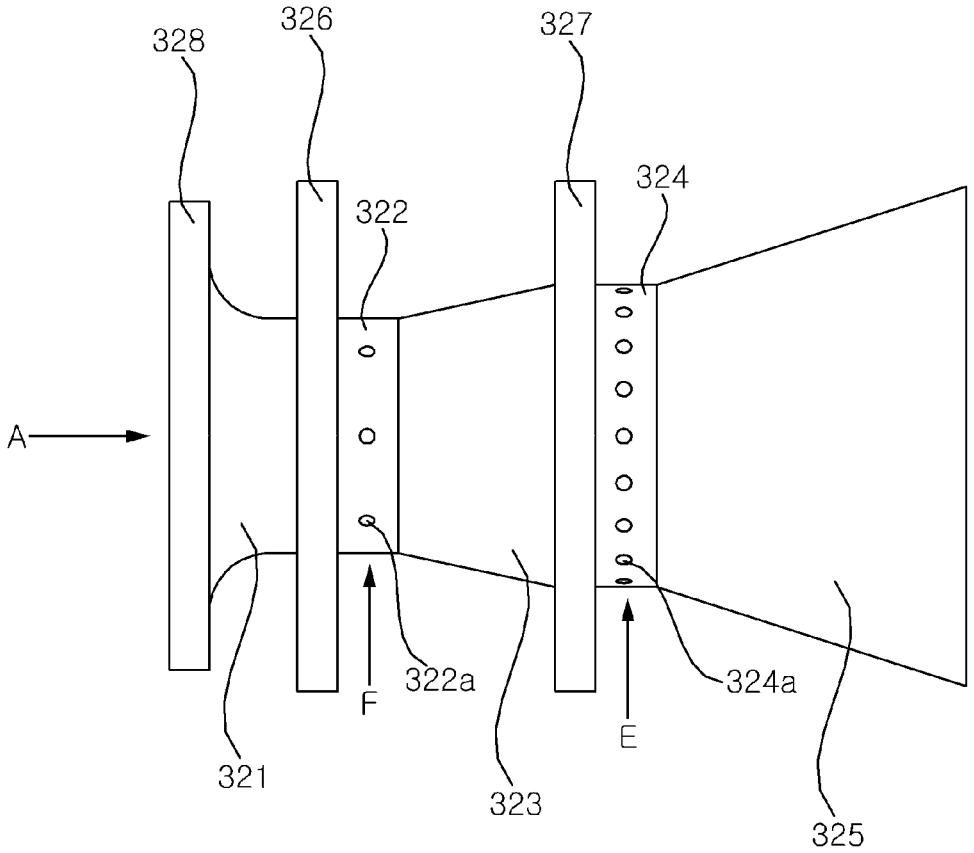
FIG. 7 is a side view of a venturi tube according to one embodiment of the present disclosure.
Figure 8:
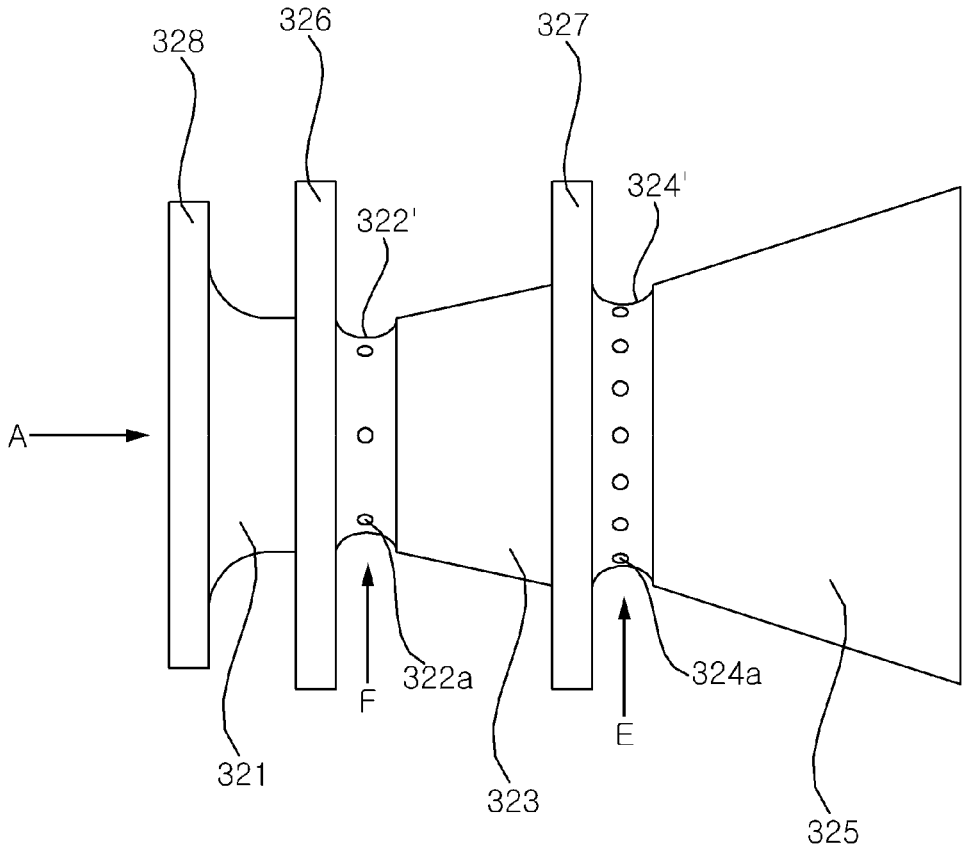
FIG. 8 is a side view of a venturi tube according to another embodiment of the present disclosure.

FIG. 6 is a perspective view of the mixer of the gas furnace according to one embodiment of the present disclosure, FIG. 7 is a side view of a venturi tube according to one embodiment of the present disclosure, and FIG. 8 is a side view of a venturi tube according to another embodiment of the present disclosure.

Referring to FIGS. 6 and 7, the mixer 32 may include a mixer housing 32*a* and a venturi tube 32*b*.

An intake pipe 31 may be connected to the front end of the mixer housing 32*a*, the mixing pipe 33 may be connected to the rear end of the mixer housing 32*a*, and the manifold 21 and the recirculation pipe 61 may be connected to the side surface of the mixer housing 32*a* such that the manifold 21 and the recirculation pipe 61 are spaced apart from each other (with reference to FIGS. 2 and 3). Here, the intake pipe 31 may be connected to the front end of the mixer housing 32*a* by an intake pipe connector 31*a*, and the mixing pipe 33 may be connected integrally to the rear end of the mixer housing 32*a*, without being limited thereto.

That is, air, the fuel gas F and the exhaust gas E may be introduced into the mixer 32 through the intake pipe 31, the manifold 21 and the recirculation pipe 33 respectively, and be mixed, and then the mixture may be supplied to the mixing pipe 33.

However, as described above, when the exhaust gas E is introduced into the mixer 32, the damper 65 is in the second state, and thus, it may be understood that the exhaust gas E is not introduced into the mixer 32 when the damper 65 is in the first state.

The venturi tube 32*b* may be located within the mixer housing 32*a*. The venturi tube 32*b* may be configured such that respective outer circumferential surfaces of a converging section 321, first and second throats 322 and 324, and first and second diverging sections 323 and 325 are spaced apart from the inner circumferential surface of the mixer housing 32*a* by designated distances.

However, the venturi tube 32*b* includes first and second flanges 326 and 327 which extend in the outward direction from the outer circumferential surface of the venturi tube 32*b* so as to be pressed against the inner circumferential surface of the mixer housing 32*a*, and thereby, the venturi tube 32*b* may be fixed to the inside of the mixer housing 32*a*.

The venturi tube 32*b* may include the converging section 321, the first throat 322, the first diverging section 323, the second throat 324 and the second diverging section 325.

The converging section 321 may be configured such that an inlet into which the air A having passed through the intake pipe 31 is introduced is formed at one end of the converging section 321 and a third flange 328 is formed on the outer circumferential surface of the end. A pressure sensor may be installed on the third flange 328 so as to sense the pressure of the air A introduced into the venturi tube 32*b*.

The converging section 321 is configured such that the diameter thereof is gradually decreased in the downstream direction. Thereby, according to the well-known venturi effect, the pressure of the air A passing through the converging section 321 may be decreased (or the flow rate of the air A may be increased), and negative pressure may be generated. Here, due to the decrease in the air pressure, the fuel gas F may be easily introduced into the venturi tube 32*b* through fuel inlet holes 332*a* formed through the first throat 322. Further, due to the increase in the air flow rate, the turbulence intensity of the air A may be increased, and thus a mixing ratio of the air A to the fuel gas F, which will be described below, may be increased.

The first throat 322 may be connected to the converging section 321, and the fuel inlet holes 322*a* into which the fuel gas F having passed through the manifold 21 is introduced may be formed through at least a portion of the side surface of the first throat 322.

In the gas furnace 10 according to one embodiment of the present disclosure shown in FIG. 7, the first throat 322 may be configured such that the diameter thereof is maintained uniform. In a gas furnace 10 according to another embodiment of the present disclosure shown in FIG. 8, a first throat 322' may be configured such that the diameter thereof is gradually decreased in the downstream direction to a designated point and is then gradually increased in the downstream direction from the designated point.

The fuel inlet holes 322*a* may include a plurality of fuel inlet holes 322*a* which are spaced apart from each other by a designated interval in the circumferential direction of the first throat 322, and thereby, the fuel gas F may be smoothly introduced into the venturi tube 32*b*.

The first diverging section 323 may be connected to the first throat 322, and in the first diverging section 323, the air A and the fuel gas F having passed through the converging section 321 and the fuel inlet holes 322*a* respectively may be mixed to produce an air-fuel mixture.

The first diverging section 323 is configured such that the diameter thereof is gradually increased in the downstream direction. Thereby, the pressure of the air, which was decreased through the converging section 321, may be restored by a designated value through the first diverging section 323, and thus, mixing of the air A and the fuel gas F may be further facilitated.

The second throat 324 may be connected to the first diverging section 323, and exhaust gas inlet holes 324*a* into which the exhaust gas E having passed through the recirculation pipe 61 is introduced may be formed through at least a portion of the side surface of the second throat 324.

In the gas furnace 10 according to one embodiment of the present disclosure shown in FIG. 7, the second throat 324 may be configured such that the diameter thereof is maintained uniform. In the gas furnace 10 according to another embodiment of the present disclosure shown in FIG. 8, a second throat 324' may be configured such that the diameter thereof is gradually decreased in the downstream direction to a designated point and is then gradually increased in the downstream direction from the designated point.

The exhaust gas inlet holes 324*a* may include a plurality of exhaust gas inlet holes 322*a* which are spaced apart from each other by a designated interval in the circumferential direction of the second throat 324, and thereby, the exhaust gas E may be smoothly introduced into the venturi tube 32*b*.

The second diverging section 325 may be connected to the second throat 324, and in the second diverging section 325, the mixture of the air A and the fuel gas F, and the exhaust gas E having passed through the first diverging section 323 and the exhaust gas inlet holes 324*a* respectively may be mixed to produce a mixture. Further, the second diverging section 325 may be configured such that an outlet from which the mixture is discharged to the mixing pipe 33 is formed at one end of the second diverging section 325.

The second diverging section 325 is configured such that the diameter thereof is gradually increased in the downstream direction. Thereby, the pressure of the air, which was decreased through the converging section 321, may be restored by a designated value through the first diverging section 323 and the second diverging section 325, and thus, a mixing ratio of the mixture of the air A and the fuel gas F to the exhaust gas E may be further increased. Accordingly, the gas furnace 10 according to the present disclosure may greatly reduce NOx emissions, compared to a conventional gas furnace which reduces NOx emissions merely by adjusting an air ratio and another conventional gas furnace which has a relatively low mixing ratio of air and fuel and thus can be expected to have a locally raised flame temperature.

The venturi tube 32*b* may include the first flange 326 which extends in the outward direction from the outer circumferential surface of a part of the converging section 321 connected to the first throat 322 so as to be pressed against the inner circumferential surface of the mixer housing 32*a*. The first flange 326 may fix the venturi tube 32*b* to the inside of the mixer housing 32*a*, and prevent the fuel gas F having passed through the manifold 21 from flowing to the outside of the converging section 321.

In addition, the venturi tube 32*b* may further include the second flange 327 which extends in the outward direction from the outer circumferential surface of a part of the first diverging section 323 connected to the second throat 324 so as to be pressed against the inner circumferential surface of the mixer housing 32*a*. The second flange 327 together with the first flange 326 may fix the venturi tube 32*b* to the inside of the mixer housing 32*a*, and prevent the exhaust gas E having passed through the recirculation pipe 61 from flowing to the outside of the first diverging section 323.

The manifold 21 may be connected to the outer circumferential surface of a part of the mixer housing 32*a* provided between the first and second flanges 326 and 327, and the recirculation pipe 61 may be connected to the outer circumferential surface of a part of the mixer housing 32*a* provided between the second flange 327 and the rear end of the mixer housing 32*a*. In this case, holes respectively connected to the manifold 21 and the recirculation hole 61 may be formed through the mixer housing 32*a*.

As apparent from the above description, a gas furnace according to the present disclosure has one or more of the following effects.

First, since, after air and fuel gas are mixed in advance in a mixer, a mixture is supplied to a burner assembly configured to perform combustion, the gas furnace according to the present disclosure may easily control the intake quantity of air for operation in a fuel lean region and consequently easily reduce NOx emissions.

Second, a portion of exhaust gas flowing in an exhaust pipe is supplied to the mixer, in which the air and the fuel gas are mixed, through rotation of a damper of a recirculator installed around the exhaust pipe, and thereby, the gas furnace according to the present disclosure lowers a flame temperature due to gas having high specific heat, such as carbon dioxide, among the exhaust gas, thus being capable of greatly reducing and fundamentally blocking NOx emissions.

Third, the gas furnace according to the present disclosure reduces the load of an inducer compared to a gas furnace which reduces NOx emissions merely by increasing an air ratio, thus being capable of achieving energy saving.

Fourth, since mixing of air and the fuel gas and/or the exhaust gas is carried out through a venturi tube within the mixer and thus a mixing ratio thereof is increased, the gas furnace according to the present disclosure may greatly reduce NOx emissions compared to a case in which the flame temperature is locally raised due to a relatively low mixing ratio.

Although the exemplary embodiments of the present disclosure have been disclosed for illustrative purposes, those skilled in the art will appreciate that various modifications, additions and substitutions are possible, without departing from the scope and spirit of the invention as disclosed in the accompanying claims.

What is claimed is:

1. A gas furnace comprising:

a mixer that mixes air and fuel gas to produce an air-fuel mixture;

a burner assembly that combusts the air-fuel mixture produced in the mixer;

at least one heat exchanger through which combustion gas produced in the burner assembly passes;

an exhaust pipe that exhausts exhaust gas having passed through the at least one heat exchanger and including a first pipe and a second pipe positioned downstream of the first pipe; and a recirculator including:

a damper housing that connects the first pipe and the second pipe;

a cylinder-shaped damper that extends in a direction crossing the damper housing, disposed inside of the damper housing, and an opening of which is formed at a lateral surface thereof; and a recirculation pipe having a first end connected to the damper housing and facing the lateral surface of the damper, and a second end connected to the mixer, wherein the damper is rotatable with respect to a longitudinal direction of the damper, and wherein when the first pipe communicates with the recirculation pipe through the opening, the first end of the recirculation pipe is positioned upstream of the second pipe.

2. The gas furnace according to claim 1, wherein the recirculator further comprises:

a rotary motor connected to one side of the damper so as to rotate the damper, wherein the damper forms a flow path configured to communicate with a flow path formed in the first pipe located at a front end of the damper housing and a flow path formed in the second pipe located at a rear end of the damper housing.

3. The gas furnace according to claim 2, wherein:

the damper, in a first state, forms a first flow path such that all of the exhaust gas introduced from the first pipe located at the front end of the damper housing into the damper is guided to the second pipe located at the rear end of the damper housing; and the damper, in a second state, forms a second flow path such that a portion of the exhaust gas introduced from the first pipe located at the front end of the damper housing into the damper is guided to the second pipe located at the rear end of the damper housing and a remainder of the exhaust gas is guided to the recirculation pipe.

4. The gas furnace according to claim 3, wherein the second state is a state in which the damper is rotated from a position of the damper in the first state at a designated angle in a designated direction by the rotary motor.

5. The gas furnace according to claim 4, wherein the rotary motor is a servomotor configured to adjust a rotational angle thereof in stages in response to a designated control signal.

6. The gas furnace according to claim 5, further comprising a controller configured to control a quantity of the exhaust gas flowing in the recirculation pipe by adjusting whether or not the rotary motor is to be rotated or the rotational angle of the rotary motor.

7. The gas furnace according to claim 2, wherein the mixer comprises:

a mixer housing configured such that an intake pipe is connected to a front end thereof, a mixing pipe is connected to a rear end thereof, and a manifold and the recirculation pipe are connected to a side surface thereof so as to be spaced apart from each other; and a venturi tube located within the mixer housing.

8. The gas furnace according to claim 7, wherein the venturi tube comprises:

a converging section provided with an inlet formed at one end thereof such that the air having passed through the intake pipe is introduced into the inlet;

a first throat connected to the converging section and provided with fuel inlet holes formed through at least a portion of a side surface thereof such that the fuel gas having passed through the manifold is introduced into the fuel inlet holes;

a first diverging section connected to the first throat and configured such that the air and the fuel gas having passed through the converging section and the fuel inlet holes respectively are mixed therein to produce the air-fuel mixture;

a second throat connected to the first diverging section and provided with exhaust gas inlet holes formed through at least a portion of a side surface thereof such that the exhaust gas having passed through the recirculation pipe is introduced into the exhaust gas inlet holes; and a second diverging section connected to the second throat and configured such that the air-fuel mixture and the exhaust gas having passed through the first diverging section and the exhaust gas inlet holes respectively are mixed therein to produce a final mixture, and provided with an outlet formed at one end thereof such that the final mixture is discharged to the mixing pipe from the outlet.

9. The gas furnace according to claim 8, wherein the converging section is configured such that a diameter thereof is gradually decreased in a downstream direction.

10. The gas furnace according to claim 8, wherein each of the first and second diverging sections is configured such that a diameter thereof is gradually increased in a downstream direction.

11. The gas furnace according to claim 8, wherein each of the first and second throats is configured such that a diameter thereof is maintained uniform.

12. The gas furnace according to claim 8, wherein each of the first and second throats is configured such that a diameter thereof is gradually decreased in a downstream direction to a designated point and is then gradually increased in the downstream direction from the designated point.

13. The gas furnace according to claim 8, wherein:

the fuel inlet holes comprise a plurality of fuel inlet holes arranged to be spaced apart from each other by a designated interval in a circumferential direction of the first throat; and the exhaust air inlet holes comprise a plurality of exhaust air inlet holes arranged to be spaced apart from each other by a designated interval in a circumferential direction of the second throat.

14. The gas furnace according to claim 8, wherein the venturi tube further comprises a first flange configured to extend in an outward direction from an outer circumferential surface of a part of the converging section connected to the first throat so as to be pressed against an inner circumferential surface of the mixer housing.

15. The gas furnace according to claim 14, wherein the venturi tube further comprises a second flange configured to extend in the outward direction from an outer circumferential surface of a part of the first diverging section connected to the second throat so as to be pressed against the inner circumferential surface of the mixer housing.

16. The gas furnace according to claim 15, wherein:

the manifold is connected to an outer circumferential surface of a part of the mixer housing provided between the first and second flanges; and the recirculation pipe is connected to an outer circumferential surface of a part of the mixer housing provided between the second flange and a rear end of the mixer housing.

17. The gas furnace according to claim 1, wherein the at least one heat exchanger comprises a plurality of heat exchangers, and wherein the burner assembly comprises:

a plurality of combustion chambers disposed adjacent to the plurality of heat exchangers;

a mixing chamber located at front ends of the plurality of combustion chambers and configured to distribute the air-fuel mixture having passed through the mixing pipe to the plurality of combustion chambers; and an igniter installed in at least one of the plurality of combustion chambers and configured to ignite the air-fuel mixture.

18. The gas furnace according to claim 17, wherein the plurality of heat exchangers is provided in a number corresponding to a number of the plurality of combustion chambers, and is arranged parallel to each other.

19. The gas furnace according to claim 1, wherein, when the first pipe communicates with the recirculation pipe through the opening, a portion of the first pipe is closed by the lateral surface of the damper.

20. The gas furnace according to claim 1, wherein the opening of the damper is a cylindrical hole perpendicular to the lateral surface of the damper.

* * * * *